US005693213A

United States Patent [19]

Shimamune et al.

[11] Patent Number: 5,693,213

[45] Date of Patent: Dec. 2, 1997

[54] ELECTROLYTIC PROCESS OF SALT WATER

[75] Inventors: Takayuki Shimamune, Tokyo; Takahiro Ashida; Yoshinori Nishiki, both of Kanagawa, all of Japan

[73] Assignee: Permelec Electrode Ltd., Kanagawa, Japan

[21] Appl. No.: 470,615

[22] Filed: Jun. 6, 1995

[30] Foreign Application Priority Data

Jun. 6, 1994 [JP] Japan ..... HEI. 6-147112

[51] Int. Cl.[6] ..... C25B 1/34

[52] U.S. Cl. ..... 205/510; 205/525

[58] Field of Search ..... 205/510, 515, 205/511, 525, 531

[56] References Cited

U.S. PATENT DOCUMENTS

| | | | |
|---|---|---|---|
| 3,917,520 | 11/1975 | Katz | 205/349 |
| 4,221,644 | 9/1980 | LaBarre | 205/532 |
| 4,376,691 | 3/1983 | Lindstrom | 204/265 |
| 4,486,276 | 12/1984 | Cohn | 205/524 |
| 4,488,947 | 12/1984 | Miles | 205/531 |
| 4,578,159 | 3/1986 | Miles et al. | 205/531 |
| 5,437,771 | 8/1995 | Shimamune | 205/466 |

FOREIGN PATENT DOCUMENTS

| | | |
|---|---|---|
| A2225539 | 11/1974 | France . |
| A4438275 | 5/1995 | Germany . |
| WO-A7900688 | 9/1979 | WIPO . |

*Primary Examiner*—John Niebling
*Assistant Examiner*—Brendan Mee
*Attorney, Agent, or Firm*—Sughrue, Mion, Zinn, Macpeak & Seas, PLLC

[57] ABSTRACT

A salt water electrolysis process for electrolyzing an aqueous alkali chloride solution capable of preventing the deterioration of a gas diffusion cathode is disclosed. A cation-exchange membrane having closely disposed to one surface thereof an insoluble metal anode and having closely adhered or mechanically attached to the opposite surface thereof a liquid permeable gas diffusion cathode is disposed in an electrolytic cell, and electrolysis is carried out while supplying salt water to the anode chamber and an oxygen-containing gas containing water as steam or fine water droplets to the cathode chamber, and an alkali hydroxide is obtained from the cathode chamber. The water-containing gas directly reaches the gas diffusion cathode and since the alkali hydroxide and the alkali carbonate formed at the surface of the cathode are dissolved in the water in the gas and removed from the electrolytic cell, deterioration of the gas diffusion cathode can be prevented.

6 Claims, 2 Drawing Sheets

ELECTROLYTIC PROCESS OF SALT WATER

FIELD OF THE INVENTION

The present invention relates to an electrolytic process for electrolyzing salt water using a gas diffusion cathode closely disposed to an ion-exchange membrane as a diaphragm to obtain an alkali hydroxide from a cathode chamber which is substantially a gaseous phase.

BACKGROUND OF THE INVENTION

A process of obtaining chlorine and sodium hydroxide by electrolyzing an aqueous sodium chloride solution is used as an electrolytic process for producing basic materials for chemicals. The electrolytic process is converted, from a mercury process using a mercury cathode, and a diaphragm process of using an asbestos diaphragm and a mild steel cathode, to an ion-exchange membrane process of using the ion-exchange membrane as a diaphragm and using an activated cathode having a small overvoltage.

The energy consumption for the production of one ton of sodium hydroxide is reduced from 3,500 to 4,000 KWH in the mercury process to 2,000 to 2,300 KWH in the ion-exchange membrane process. For further reducing the amount of energy consumed, a process of carrying out electrolysis while supplying an oxygen-containing gas into a cathode chamber having equipped thereto a gas diffusion cathode to save energy consumption used for hydrogen generation has been proposed.

The process uses an electrolytic cell as shown in FIG. 1 of the accompanying drawings. As shown in FIG. 1, an electrolytic cell 1 is partitioned into an anode chamber 3 and a cathode chamber 4 by an ion-exchange membrane 2, a porous anode 5 is closely disposed to the surface of the anode membrane 3 side of the ion-exchange membrane. In the cathode chamber 4 is disposed a gas diffusion cathode 8 on opposite sides of which are composed of a hydrophilic layer 6 and a gas diffusion layer 7. The cathode chamber 4 is therefore partitioned into a solution chamber 9 and a gas chamber 10 by the gas diffusion cathode 8. Electrolysis is carried out while supplying an aqueous sodium chloride solution into the anode chamber 3 of the electrolytic cell 1, supplying a dilute aqueous sodium hydroxide solution or water into the solution chamber 9, and supplying an oxygen-containing gas into the gas chamber 10. Sodium hydroxide and chlorine are formed according to the reaction shown below.

The anodic reaction and the cathodic reaction in the conventional electrolytic process are as follows;

Anode $2Cl^- \rightarrow Cl_2 + 2e^-$ ($E_o$=1.36V vs NHE)

Cathode $2H_2O + 2e^- \rightarrow 2OH^- + H_2$ ($E_o$=−0.83V vs NHE), and the theoretical electrolytic voltage is 2.19 volts.

When the reaction is carried out while supplying an oxygen-containing gas into the cathode chamber using a gas diffusion cathode, the reactions in both electrodes are as follows;

Anode $2Cl^- \rightarrow Cl_2 + 2e^-$ ($E_o$=1.36V vs NHE)

Cathode $H_2O + \frac{1}{2}O_2 + 2e^- \rightarrow 2OH^-$ ($E_o$=0.4 volt).

From the above, the theoretical electrolysis voltage is 1.36−0.4=0.96 volts.

Theoretically, it is possible to reduce the consumption of electric power by more than 40% (about 1.23 volts). The actual reduction of electric power in an experimental electrolytic scale is said to be about 0.9 volts, and it is concluded that the difference between the theoretical value and the actual value is the difference in the overvoltage of the electrode.

Since an electrolysis voltage reduction of 0.9 volts is linked to lowering the consumption of electric power to about 700 KWH per ton of sodium hydroxide, the attempt to put sodium chloride electrolysis by the ion-exchange membrane process utilizing the gas diffusion cathode to practical use has been performed since the first half of the 1980's.

However, no attempts have yet succeeded on an industrial scale and the reason thereof is assumed as follows.

First, the concentration of sodium hydroxide formed at the cathode is from 30 to 35%, which provides a very corrosive atmosphere; and a gas diffusion cathode material that is capable of enduring such a corrosive atmosphere has not yet been found. That is, in the case of almost all conventional gas diffusion cathodes, an electroconductive carbon is extended on a core material or is spread in sheet form, one surface thereof is subjected to a hydrophobic treatment as a gas diffusion layer, and the opposite surface is subjected to a hydrophilic treatment, and a catalyst is applied to the hydrophilic surface. The structure tends to gradually lose hydrophobicity in high concentrations of sodium hydroxide solution, whereby there are no problems at at least the initial stage in the conventional process shown in FIG. 1 wherein the cathode chamber 4 is partitioned into the solution chamber 9 and the gas chamber 10, but it causes problems in the operation after a long period of time.

Second, when air is used as an oxygen-containing gas, carbon dioxide gas in the air is deposited as sodium carbonate, which clogs the gas diffusion layer of the gas diffusion cathode. This is the largest problem hindering the practical use of the conventional process, and even when the carbon dioxide gas is removed before electrolysis, a slight amount of carbon dioxide gas remains in the supplied oxygen-containing gas such that the remaining gas causes clogging of the gas diffusion layer. Therefore, the problem of the carbon dioxide gas remains a fundamental unsolved problem for performing electrolysis on a large scale.

Third, since a gas is not generated in the cathode chamber, stirring the liquid in the cathode chamber is insufficient to create a temperature distribution and a liquid concentration distribution, and thus the alkali concentration near the gas diffusion cathode becomes substantially high, accelerating consumption of the electrode.

SUMMARY OF THE INVENTION

Accordingly, an object of the present invention is to provide a salt water electrolytic process capable of overcoming the above three problems in the conventional process.

That is, the salt water electrolytic process according to the present invention comprises carrying out electrolysis while supplying salt water to the anode chamber, and an oxygen-containing gas and water to the cathode chamber of the electrolytic cell wherein a cation-exchange membrane as a diaphragm having an insoluble metal anode adjacent to one surface thereof in a substantially closely adhered state and also a liquid-permeable gas diffusion cathode adjacent to the opposite surface thereof in a substantially closely adhered state is disposed, and obtaining an alkali hydroxide in the cathode chamber which is also a gas chamber in a substantially gaseous phase.

DETAILED DESCRIPTION OF THE INVENTION

Figure 1:
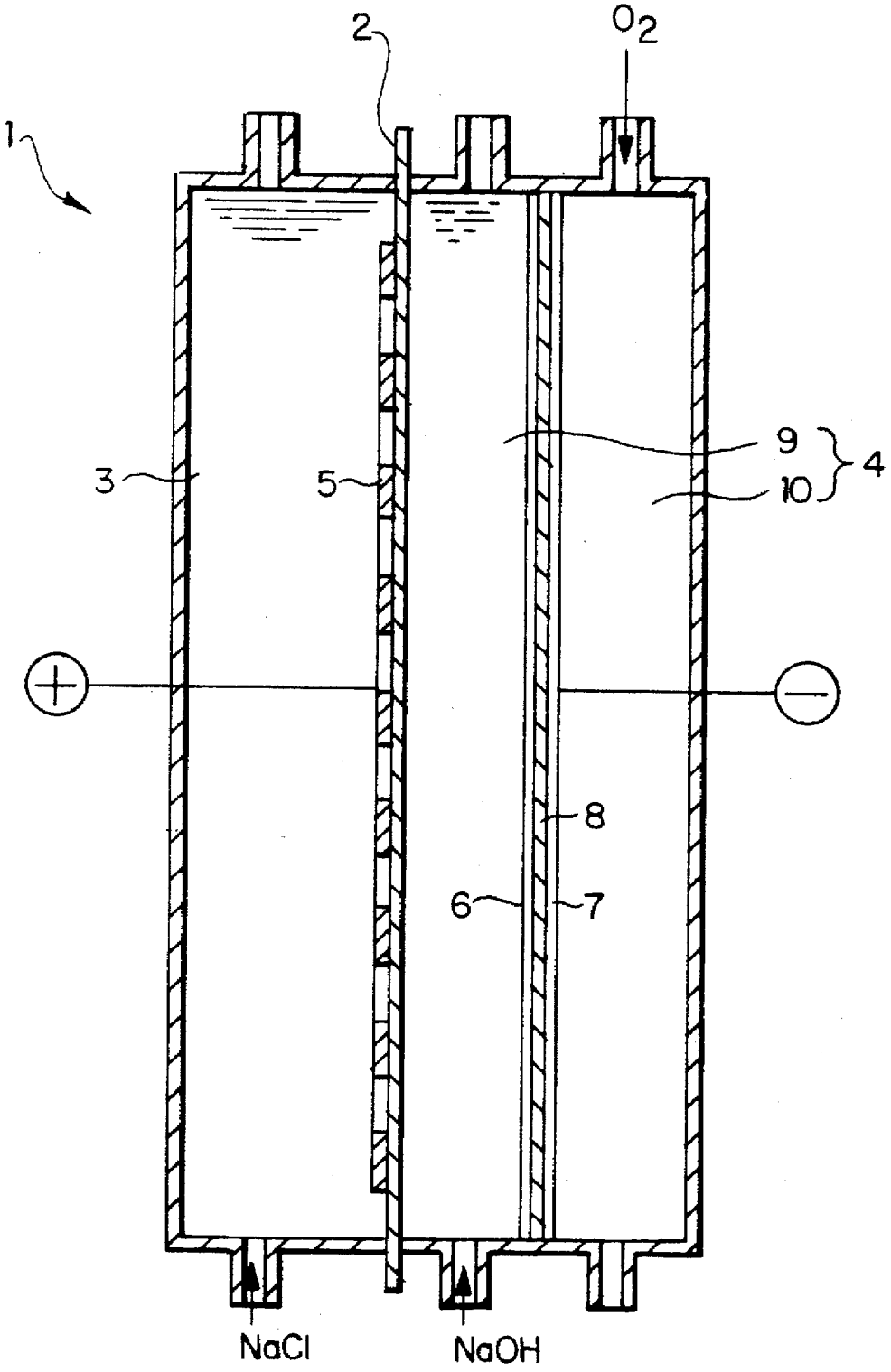
FIG. 1 PRIOR ART
FIG. 1 is a schematic vertical sectional view showing a salt water electrolytic cell using a conventional gas diffusion cathode.

The present invention is described in detail below.

As described above, the practical use of conventional salt water electrolysis, such as an aqueous sodium chloride solution, etc., by an ion-exchange membrane process using a conventional gas diffusion cathode, is delayed by three problems: the hydrophilic layer where the so-called three-phase structure is formed is immersed in a directly-formed highly-concentrated sodium hydroxide solution, whereby the hydrophilic layer is released from the gas diffusion layer bonded thereto to lose hydrophobicity in a short period of time, the gas diffusion cathode is in contact with the highly-concentrated sodium hydroxide solution for a relatively long period of time, whereby the gas diffusion cathode is consumed by chemical corrosion, etc. The present inventors have earnestly investigated these problems and have succeeded in accomplishing the objectives of the present invention.

In a conventional electrolytic process using a gas diffusion cathode, the hydrophilic layer of the gas diffusion cathode and the gas diffusion layer connected thereto are liable to corrode by being in contact with a high concentration of an aqueous sodium hydroxide solution, and in this high concentration region, a hydroxyl ion, forming sodium hydroxide, is formed. However, it is not inevitable for the hydroxyl ion to form in the highly-concentrated aqueous sodium hydroxide solution. In other words, as is clear from the reaction formula for the formation of the hydroxyl ion, $H_2O+\frac{1}{2}O_2 \rightarrow 2OH^-$, if only water and hydrogen exist, a hydroxyl ion is formed and there is no hindrance in the formation of sodium hydroxide by the hydroxyl ion reacting with a sodium ion coming from the anode chamber through the ion-exchange membrane. Accordingly, the solution chamber containing a highly-concentrated aqueous sodium hydroxide solution formed in the electrolytic cell using a conventional gas diffusion cathode is not indispensable.

It is necessary to prevent the deterioration of the gas diffusion cathode by quickly removing the sodium hydroxide that is formed in the gas diffusion cathode, so that sodium hydroxide does not come in contact with the gas diffusion cathode for a long period of time.

As water which is necessary for the reaction, only water accompanied with $Na^+$ transferring through the membrane is insufficient. For maintaining a high electric current efficiency, it is necessary to supply water into the cathode chamber. However, for quickly proceeding the oxygen reduction reaction, a cathode chamber which is in a gaseous phase is preferred, and it is also desirable for water to be supplied as fine water droplets having a size of, for example, 1 μm to 1 mm. As a result, when water is supplied to the gas diffusion cathode as a reactant that is necessary for the smooth electrolytic reaction and high current efficiency, sodium hydroxide formed and controlled its concentration at the gas diffusion cathode is quickly removed from the gas diffusion cathode into the stream of oxygen-containing gas, whereby the highly-concentrated aqueous sodium hydroxide solution does not remain in the gas diffusion cathode, such that deterioration of the gas diffusion cathode can be prevented.

Thus, in the present invention, the cathode chamber is not partitioned into a solution chamber and a gas chamber, as in a conventional gas diffusion cathode employed in salt water electrolysis using a conventional gas diffusion cathode. In the present invention, the electrolytic cell with closely adjacent gas diffusion cathode to an ion-exchange membrane is formed, and electrolysis is carried out while supplying steam in a super saturated state or water in a mist form and while supplying an oxygen-containing gas to the cathode chamber of the electrolytic cell.

According to the process of the present invention, since sodium hydroxide formed at the gas diffusion cathode is diluted and washed with water in the oxygen-containing gas, sodium hydroxide is removed from the gas diffusion cathode within a short period of time (e.g., quickly), such that the gas diffusion cathode is not in contact with a highly concentrated aqueous sodium hydroxide solution and the hydrophobicity of the gas diffusion cathode is scarcely lost. As a result, the first problem in the conventional technique described above is solved.

Furthermore, in the process of the present invention, a gas stream containing fine water droplets exists near the electrode in the cathode chamber such that the poor concentration distribution and the poor temperature distribution do not exist. As a result, the third problem in the conventional technique described above is solved.

Also, in the present invention, the gas diffusion cathode is cleaned with water contained in the oxygen-containing gas supplied to the cathode chamber, that is, even when sodium carbonate is formed by the reaction of a sodium ion and a carbon dioxide gas in the air described above, the sodium carbonate deposited on the surface of the gas diffusion cathode and on the inside thereof is dissolved in water that is continuously supplied into the cathode chamber and removed from the gas diffusion cathode, whereby the water scarcely contacts the gas diffusion cathode again, such that the resulting sodium carbonate does not accumulate, whereby clogging of the gas diffusion cathode does not occur. As a result, the second problem in the conventional technique described above is solved. For attaining such a purpose, the size of the fine water droplets is preferably from 1 μm to 2 mm.

Also, for converting a salt water electrolytic cell using a conventional metal cathode to an electrolytic cell using a conventional type of gas diffusion cathode, the cathode chamber is partitioned into a solution chamber and a gas chamber by a gas diffusion cathode, requiring a large reconstruction cost. On the other hand, in the present invention, it is unnecessary to partition the cathode chamber, and hence the conventional electrolytic cell can be converted to an electrolytic cell for use in the present invention without requiring large reconstruction costs.

Each part of the electrolytic cell used in the present invention is explained below.

There is no particular restriction on the ion-exchange membrane as a diaphragm. The ion-exchange membrane used in this invention may be properly selected from fluorinated cation-exchange membranes, and preferably perfluorocarbon-type ion-exchange membranes, which are industrially used at present for salt water electrolysis. The ion-exchange membrane generally has a thickness of from 100 to 500 μm. According to the kind of ion-exchange membrane, there is an ion-exchange resin membrane comprising a surface with a coated layer composed of a ceramic, etc., to keep the surface hydrophilic and such an ion-exchange membrane can be used as it is, if the coated layer does not produce negative influences on the control of the concentration of sodium hydroxide at the cathode side.

Adjacent to the anode side of the ion-exchange membrane is closely disposed an anode, preferably a porous insoluble electrode, which is conventionally used as an anode for salt water electrolysis. The anode generally has a thickness of from 0.1 to 5 mm. Specific example of the porous insoluble electrode is a so-called DSA (Dimensionally StableAnode) which is generally used in chloralkali electrolysis.

Adjacent to the cathode side of the ion-exchange membrane is closely adhered or mechanically attached a gas diffusion cathode. There is no particular restriction on the gas diffusion cathode and, for example, a three-phase structure composed of a thin support cloth formed by plain-weaving carbon fibers having the gas diffusion layer at one surface thereof and a hydrophilic layer coated on the opposite surface thereof can be used. The gas diffusion cathode generally has a thickness of from 0.1 to 5 mm.

The gas diffusion layer can be formed by coating a kneaded mixture of a dispersion of hydrophobic carbon for facilitating the gas diffusion and polytetrafluoroethylene (PTFE) and electroconductive carbon mainly composed of graphite followed by baking at 330° to 400° C. Also, the hydrophilic layer can be formed, for example, by baking a mixture of electroconductive particles and electroconductive particles having provided on the surface thereof catalyst particles using a dispersion of a fluoro resin such as PTFE, etc., as a binder or chemically baking or applying by physical vapor deposition (PVD) or chemical vapor deposition (CVD) catalyst particles on the surfaces of electrically conductive particles previously baked. Examples of the catalyst are Pt, Ag, Co, Ni and Au. The hydrophilic layer may be prepared by any method described above. Carbon particles having particle sizes of from about 0.01 to 10 μm, which are larger than the particles used for an ordinary gas diffusion electrode, are desirably used, and it is also preferred that the particle size distribution of the carbon particles is not large (e.g., 0.01–10 μm). By using such carbon particles, through-holes can be ensured to improve the liquid permeability.

The gas diffusion cathode also can be prepared with metal such as Ni, Cu, Ag, stainless steel or Ti. For example, thinly knitted nickel mesh is used as a substrate, and onto both surfaces of the substrate is coated a kneaded mixture of a powder of nickel or stainless steel having a uniform particle size (e.g., 0.01–10 μm), such as carbonyl nickel, etc., with water or an alcohol, together with a medium such as dextrin, etc. The substrate thus coated is subjected to a so-called loose sintering at a temperature of from 400° C. to 800° C. in a weak reducing atmosphere containing a hydrogen gas to form a porous layer on both surfaces of the substrate. Thereafter, one surface of the substrate is thinly impregnated with a PTFE resin to form a gas diffusion layer and a liquid containing a catalyst material is coated on the opposite side of the substrate and baked to form a hydrophilic layer, whereby a gas diffusion cathode is prepared. The gas diffusion cathode may be prepared by coating the surfaces of a porous metal foam made of silver, further rendering the surfaces hydrophobic.

The catalyst itself may be the same as in a conventional electrode material, such as platinum black, silver, silver cobalt, gold, ruthenium oxide, iridium oxide, etc. In the case of the metal substrate, the dispersion or solution containing the catalyst material described above is coated thereon and may be directly baked at a temperature of from 300° C. to 600° C. or may be baked at a temperature of from 100° C. to 350° C. using a binder such as TEFLON (trade name for polytetrafluroethylene, made by E.I. du Pont de Nemours & Co., Inc.), etc. Also, the catalyst material may be vapor deposited by methods such as PVD, CVD, etc.

The gas diffusion cathode may be closely adhered or mechanically attached adjacent to the ion-exchange membrane by applying a pressure of from 1 to 10 kg/cm$^2$ between them without carrying out a specific adhesion, and further they may be closely adhered adjacent to each other by hot-pressing them at a temperature of from 100° C. to 300° C. using a liquid of a fluoro resin having an ion-exchange function commercially available as a NAFION (trade name for perfluorinated cation-exchange membrane, made by E.I. du Pont de Nemours & Co. inc.) liquid as a binder.

In addition, there is no particular restriction on the current collector which is placed on the gas diffusion cathode but it is desirable to use a fine mesh prepared by knitting a nickel or stainless steel wire having a diameter of from about 0.1 mm to 1 mm such that an oxygen-containing gas can sufficiently be spread over the gas diffusion cathode.

Adjacent to the opposite surface of the ion-exchange membrane is disposed the anode described above. Then, the ion-exchange membrane having the gas diffusion cathode on one side and the anode on the opposite side is disposed in an electrolytic cell to obtain the salt water electrolytic cell.

When using the conventional two-chamber process electrolytic cell, the salt water electrolytic cell may be constructed by disposing the ion-exchange membrane such that the insoluble metal anode is closely adhered to one surface of the ion-exchange membrane. In this case, the existing cathode may be used as the cathode current collector. Also, in the case of a filter press-type electrolytic cell, the salt water electrolytic cell may be constructed by inserting the ion-exchange membrane between the existing anode and the cathode current collector and closely adhering them alternately.

Salt water having a concentration of 150–250 g/liter as NaCl, such as an aqueous sodium chloride solution, an aqueous potassium chloride solution, etc., and preferably saturated salt water is supplied to the anode chamber side of the electrolytic cell at a rate so as to keep the concentration of 150–200 g/l and electrolysis is carried out while supplying an oxygen-containing gas, i.e., an oxygen gas or air containing fine water droplets, to the cathode chamber side in an amount of 1.5–3 times larger than that of the theoretically required amount. The salt water and oxygen-containing gas are supplied at 80°–90° C. for the uniform electrolysis.

In this case, the amount of water contained in the oxygen-containing gas is changed according to the characteristics of the ion-exchange membrane. For example, when using the most general carboxylic acid-series ion-exchange resin membrane, when the concentration of sodium hydroxide is 32% and the transport number n of water permeating through the ion-exchange membrane is from 3.5 to 4, the voltage is lowest and stabilized.

The cathodic reaction is $\frac{1}{2}O_2+H_2O \rightarrow 2OH^-$, and ½ mole of water is required per mole of sodium hydroxide. The amount of water to be supplied when n is 3.5 and 4 are 1.7 moles and 1.2 moles, respectively, and it can be seen that steam or fine water droplets of from 5 to 7 times the volume 1 of the oxygen-containing gas is required for the reaction. In addition, by supplying an oxygen gas or air at a pressure of from about 0.5 to 3 atms, the electrolysis can be easily operated.

As a water supplying method, part of the water is added to the oxygen-containing gas as steam and the other part is added thereto as fine water droplets, whereby the cathode can always be cleaned with water. For example, fine water droplets having a diameter of 1 μm are added in an amount of $10^6$ per cm$^2$.min. By controlling the water content in the supplying gas as described above, electrolysis can always be carried out under the best conditions.

In addition, when using an ion-exchange membrane and obtaining a highly concentrated alkali hydroxide, a substantial transport of water is reduced and, hence, as a matter of course, the supply of a considerable amount of water is required in such an amount that the alkali hydroxide concentration is kept at 30–35 wt % in NaCl cell and the ion-exchange membrane can also be used in the present invention.

By such an electrolytic operation, the cathode is always kept in a wet state and sodium hydroxide formed is removed by being dissolved in the fine water droplets, whereby the gas diffusion cathode is not immersed in a highly concentrated aqueous sodium hydroxide solution as in the conventional case described above. Thus, stable electrolytic conditions can be ensured, and the deterioration of the gas diffusion cathode can effectively be prevented. Furthermore, in the present invention, sodium carbonate which is deposited and accumulated in the gas diffusion cathode and which has a possibility of deteriorating the gas diffusion cathode can be removed by being dissolved in the fine water droplets. Thus, clogging of the gas diffusion cathode by carbon dioxide gas in air, which is the most serious problem in the practical use of the gas diffusion cathode, can be avoided without previously carrying out the removal operation of a carbon dioxide gas in air.

Figure 2A:
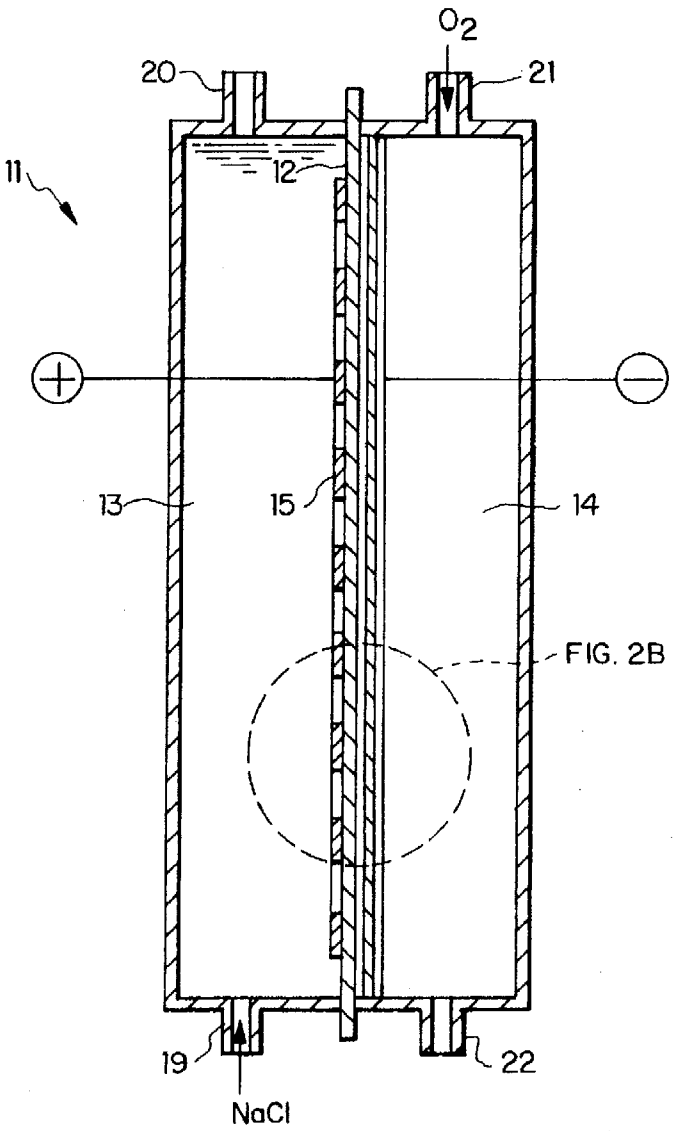
FIGS. 2A and 2B are schematic vertical sectional views showing a salt water electrolytic cell using a gas diffusion cathode of the present invention.
Figure 2B:
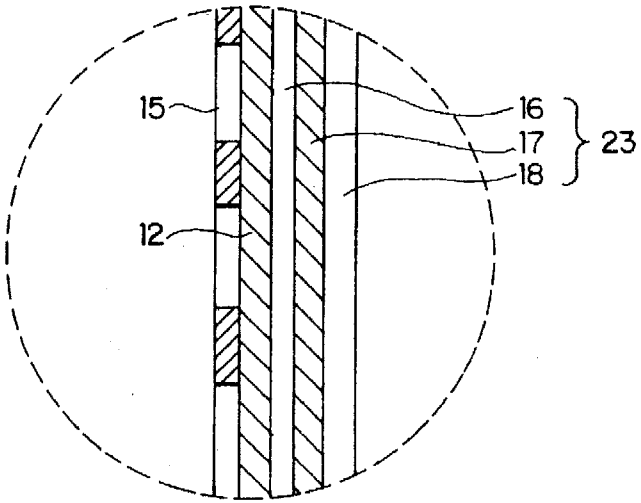

FIGS. 2A and 2B of the accompanying drawings are a vertical sectional view showing an embodiment of the salt water electrolytic cell capable of being used for the salt water electrolytic process of the present invention.

In FIGS. 2A and 2B, an electrolytic cell 11 is partitioned into an anode chamber 13 and a cathode chamber 14 by an ion-exchange membrane 12, adjacent to the surface of the ion-exchange membrane 12 at the anode chamber 13 side is mechanically attached a porous anode 15 and adjacent to the surface of the ion-exchange membrane 12 at the cathode chamber 14 side is supported a hydrophilic layer 16 of a gas diffusion cathode 23 comprising the hydrophilic layer 16, a cathode substrate 17, and a gas diffusion layer 18, in a closely adhered state. The gas diffusion cathode 23 comprises the cathode substrate 17 having coated on both surfaces thereof the hydrophilic layer 16 and the gas diffusion layer 18. The hydrophilic layer 16 contacts the ion-exchange member 12. A current collector (not shown) is placed on the gas diffusion cathode. An inlet 19 for an aqueous sodium chloride solution and an outlet 20 for the aqueous sodium chloride solution are formed at the lower portion and upper portion, respectively, of the anode chamber 13. An inlet 21 for an oxygen-containing gas and an outlet 22 for the oxygen-containing gas are equipped at the upper portion and the lower portion, respectively, of the cathode chamber 14.

When an electric current is passed through both electrodes at a current density of 20–40 A/cm$^2$ while introducing a saturated aqueous sodium chloride solution from the inlet 19 and wet air from the inlet 21 of the electrolytic cell thus formed, water that permeates through the gas diffusion layer 17 reacts with oxygen at the hydrophilic layer 16 side of the gas diffusion cathode 18 to form a hydroxyl ion and the hydroxyl ion reacts with sodium ions that permeated through the ion-exchange membrane 12 from the anode chamber 13 side to form sodium hydroxide.

Sodium hydroxide formed is diluted with water in wet air and is kept in a proper concentration at the membrane. Sodium carbonate formed by the reaction of a carbon dioxide gas in the air is dissolved in water in the wet air and discharged from the electrolytic cell through the outlet 22 for the oxygen-containing gas.

In the above operation, the case of electrolyzing sodium chloride only by the electrolytic process of the present invention is explained but the invention can be similarly used for the electrolysis of forming other alkali metal hydroxides in the cathode side from other alkali chlorides such as potassium chloride; an alkali metal halide such as sodium bromide; sea water, sodium nitrate; etc.

Then, the examples of the salt water electrolytic cell used for the process of this invention and the salt water electrolytic process of the present invention are described below but the invention is not limited to these examples.

EXAMPLE 1

Adjacent to one surface of a cathode substrate made of a hand woven cloth of graphatized pitch-series carbon fibers having a thickness of 0.2 mm was coated a kneaded mixture of graphite particles having a diameter of 5 μm and a PTFE dispersion by a doctor blade method at a thickness of 0.4 mm followed by drying, and thereafter, the substrate thus coated was solidified by heating by hot-pressing under the conditions of 200 kg/cm$^2$ and 300° C., whereby a hydrophobic layer having a thickness of 0.2 mm was formed adjacent to the surface of the cathode substrate.

Adjacent to the opposite surface of the cathode substrate was similarly coated a kneaded mixture of silver particles having particle sizes of about 0.1 μm and carbon particles having particle sizes of about 0.1 μm, each sufficiently dispersed in the other, dried, and solidified by heating to form a hydrophilic layer having a thickness of 0.1 mm, whereby a gas diffusion cathode composed of the cathode substrate having the hydrophobic layer and the hydrophilic layer adjacent to opposite surfaces thereof was prepared.

The surface of the gas diffusion cathode at the hydrophilic layer side was closely adhered to one surface of a cation-exchange membrane by NAFION 90207 (trade name, made by E.I. du Pont de Nemours & Co. Ltd.) at a pressure of 200 kg/cm$^2$ and the assembly was incorporated in a test electrolytic cell composed of a cylindrical glass having a diameter of 90 mm and an acrylic resin shown in FIGS. 2A and 2B. As an anode, a fine mesh of an insoluble anode having formed thereon a coated layer composed of ruthenium oxide and titanium oxide was used and press-adhered to the opposite surface of the cation-exchange membrane. As a cathode current collector, a mesh having an opening of 1 mm formed by knitting a nickel wire having a diameter of 0.2 mm was used and the mesh was pressed in the direction of the gas diffusion cathode to integrate the ion-exchange membrane and the gas diffusion cathode in a body followed by fixing.

To the anode chamber side of the electrolytic cell was supplied a saturated aqueous sodium chloride solution where the flow rate was controlled such that the concentration thereof at the outlet became 200 g/liter. To the cathode chamber were supplied an oxygen gas sufficiently saturated with water passed through a pre-wetting bath of 90° C. and fine water droplets. Then, when electrolysis was carried out at an electrolytic temperature of 90° C. and a current density of 30 A/dm$^2$, the cell voltage was 2.1 volts and sodium hydroxide in a concentration of from 30 to 33% could be obtained from the cathode chamber.

When electrolysis was continuously operated for one week while recovering sodium hydroxide formed from the outlet for the oxygen-containing gas as shown in FIG. 2A, the voltage was stable, no change of the product was observed and dissolution of the catalyst was not observed.

EXAMPLE 2

As the cathode substrate, a mesh formed by knitting a nickel wire having a diameter of 0.1 mm was used and a kneaded mixture composed of a carbonyl nickel powder having a particle size of about 5 μm and a small amount of dextrin as a binder dissolved in water was coated on both surfaces of the substrate. The cathode substrate thus coated was subjected to loose sintering at 600° C. for 15 minutes in an atmosphere of flowing a gas mixture composed of a nitrogen gas mixed with a hydrogen gas in an amount of 1/150 by volume of the nitrogen gas. One surface of the substrate was impregnated with a PTFE resin liquid and after coating a dispersion formed by dispersing platinum black in a PTFE resin liquid on the opposite surface of the substrate, the substrate was baked in a muffle furnace at 300° C.

The platinum black side of the gas diffusion cathode thus prepared was closely adhered to the ion-exchange membrane as used in Example 1 and the assembly thus obtained was incorporated in the same electrolytic cell as used in Example 1. Then, when electrolysis was carried out under the same conditions as in Example 1, the cell voltage was 1.95 volts and when electrolysis was continuously carried out for 90 days, no change occurred.

EXAMPLE 3

After depositing silver on a polyurethane foam, a so-called silver foam having a thickness of 1 mm and a porosity of 95% was prepared by removing urethane and the silver foam was pressed to a thickness of 0.5 mm. The one surface of the silver foam was impregnated with a PTFE resin liquid and the silver foam was baked to obtain a gas electrode. Then, the opposite surface of the electrode to the surface impregnated with the PTFE resin liquid was closely adhered to the ion-exchange membrane, NAFION 350 (trade name) and the ion-exchange membrane having the electrode was incorporated in the electrolytic cell as used in Example 1.

Then, electrolysis was carried out while flowing a saturated aqueous potassium chloride solution as an anolyte such that the flow rate thereof became 500 g/liter at the outlet of the solution and also while sending air saturated with steam containing fine water droplets having a diameter of about 100 μm as a cathode gas.

In electrolysis, the cell voltage was 2.0 volts and 300 g/liter of potassium hydroxide was obtained. After observing the operation for one week, the cell voltage and potassium chloride formed were not changed.

As described above, the present invention is a salt water electrolytic process, which comprises carrying out electrolysis while supplying salt water to the anode chamber of an electrolytic cell wherein a cation-exchange membrane as a diaphragm having an insoluble metal anode adjacent to one surface thereof in a substantially closely adhered state and having a liquid-permeable gas diffusion cathode adjacent to the opposite surface thereof in a substantially closely adhered state is disposed and supplying a gas containing water and oxygen to the cathode chamber to obtain an alkali hydroxide in the cathode chamber.

In the present invention, since the gas diffusion cathode is closely adhered to the ion-exchange membrane, or in other words, since a conventional solution chamber does not exist in the electrolytic cell and a gas stream directly reaches the reaction surface of the cathode to accelerate mass transfer, a highly concentrated aqueous alkali hydroxide solution is quickly removed. Furthermore, sodium hydroxide formed at the gas diffusion cathode is dissolved in water contained in the oxygen-containing gas and removed from the electrolytic cell. Accordingly, the gas diffusion cathode does not contact the highly concentrated aqueous sodium hydroxide solution, and even when it does contact the solution, the contact time is very short, so that deterioration of the characteristics of the gas diffusion cathode, such as the loss of hydrophobicity, etc., does not occur and stable operation for a long period of time is ensured.

Also, the problems of the deposition of sodium carbonate formed by the carbon dioxide gas contained in air and clogging of the ion-exchange membrane by the sodium carbonate, which is the most serious problem in conventional practical processes, can be easily avoided since deposited sodium carbonate is dissolved in water described above and removed from the electrolytic cell, and thus the conventional problems can all be solved.

Furthermore, in the electrolytic cell used in the process of the present invention, the cathode chamber is not partitioned into a solution chamber and a gas chamber by a gas diffusion cathode and hence a conventional two-chamber process salt water electrolytic cell and filter press-type salt water electrolytic cell, each without using a gas diffusion cathode, can be diverted to use for the process of the present invention without requiring high reconstruction costs.

By adhering the cation-exchange membrane to the gas diffusion cathode according to the present invention, both members are integrated in a body in a stabilized state and electrolysis can be stably operated for a long period of time.

Also, in the present invention, the gas diffusion cathode is cleaned with water contained in the oxygen-containing gas supplied to the cathode chamber and for attaining the function, the sizes of the fine water droplets are from 1 μm to 2 mm, preferably from 1 μm to 1 mm.

While the invention has been described in detail and with reference to specific embodiments thereof, it will be apparent to one skilled in the art that various changes and modifications can be made therein without departing from the spirit and scope thereof.

What is claimed is:

1. A salt water electrolytic process for conducting electrolysis comprising the steps of:

(a) supplying salt water to an anode chamber of an electrolytic cell, (b) supplying a gas composition comprising water and oxygen to a cathode chamber of the electrolytic cell, and (c) producing an alkali hydroxide in the cathode chamber, wherein the electrolytic cell comprises an ion-exchange membrane as a diaphragm, an insoluble metal anode, and a liquid-permeable gas diffusion cathode, wherein the liquid-permeable gas diffusion cathode comprises a gas diffusion layer, a cathode substrate and a hydrophilic layer, in that order, wherein the gas diffusion layer is adjacent to the ion exchange membrane, and wherein a gas stream moves through the cathode chamber.

2. The salt water electrolytic process of claim 1, wherein the insoluble metal anode is adjacent to the ion-exchange membrane on the anode chamber side of the ion-exchange membrane and the liquid-permeable gas diffusion cathode is adjacent to the ion-exchange membrane on the cathode chamber side of the ion-exchange membrane.

3. The salt water electrolytic process of claim 1, wherein a concentration of the alkali hydroxide formed in the cathode chamber is controlled to a desired value by the gas composition being supplied to the cathode chamber, and wherein the cathode chamber mainly comprises a gaseous phase by volume.

4. The salt water electrolytic process of claim 1, wherein the water in the gas composition comprises droplets which have super-saturated the gas.

5. The salt water electrolytic process of claim 4, wherein the water in the gas composition comprises droplets having a size of from 1 μm to 2 mm.

6. The salt water electrolytic process of claim 5, wherein the water in the gas composition comprises droplets having the size of from 1 μm to 1 mm.

* * * * *